US007134559B2

(12) United States Patent
Zoueki

(10) Patent No.: US 7,134,559 B2
(45) Date of Patent: Nov. 14, 2006

(54) EYEGLASS FRAME HOLDER

(75) Inventor: Georges Zoueki, Montréal (CA)

(73) Assignee: Creations Geocraft Inc., Montréal (CA)

( * ) Notice: Subject to any disclaimer, the term of this patent is extended or adjusted under 35 U.S.C. 154(b) by 346 days.

(21) Appl. No.: 10/812,899

(22) Filed: Mar. 31, 2004

(65) Prior Publication Data

US 2004/0200790 A1 Oct. 14, 2004

(30) Foreign Application Priority Data

Apr. 9, 2003 (CA) ..... 2425017

(51) Int. Cl.
*A47F 7/02* (2006.01)

(52) U.S. Cl. ..... 211/85.1

(58) Field of Classification Search ..... 211/85.1; 248/902

See application file for complete search history.

(56) References Cited

U.S. PATENT DOCUMENTS 4,558,788 A 12/1985 Grothaus
4,588,788 A * 5/1986 Emmons et al. ..... 525/531
4,724,966 A * 2/1988 Benaksas ..... 211/85.1
4,805,781 A * 2/1989 Tegel ..... 211/85.1
4,890,745 A 1/1990 Holden
6,182,840 B1 * 2/2001 Tegel ..... 211/85.1
6,364,124 B1 * 4/2002 Chen ..... 211/4

* cited by examiner

*Primary Examiner*—Sarah Purol
(74) *Attorney, Agent, or Firm*—Robic

(57) ABSTRACT

An eyeglass frame holder for holding and displaying eyeglasses of different size and thickness. The eyeglass frame holder has one or more vertical posts to which one or more supporting members are for supporting an eyeglass frame having two glass retaining portions joined by a bridge portion. A pair of retaining pins are symmetrically mounted onto each of the supporting members at a short distance from the vertical post to which the supporting member is attached. Each supporting member is connected to the vertical post in such a way so as to project horizontally from it. Each supporting member is also shaped and sized to fit into and support the bridge portion of the eyeglass frame. The pair of retaining pins extend coaxially in an horizontal direction perpendicular to the vertical post so as to come into contact and hold the glass retaining portions on both sides of the bridge portion below the same where the eyeglass frame is positioned onto the supporting member. Such allows the eyeglass frame to be held onto the eyeglass holder with its glass retaining portions extending in a substantially vertical plane. The above eyeglass frame holder may also be provided with a locker to keep the eyeglasses secure from any attempt of theft.

18 Claims, 9 Drawing Sheets

EYEGLASS FRAME HOLDER

FIELD OF THE INVENTION

The present invention relates to a merchandising display device for eyeglasses or sunglasses. More particularly, it relates to an eyeglass frame holder of the type wherein the eyeglass frames are held with their bridges sitting onto supporting members attached to one or more vertical posts.

BACKGROUND OF THE INVENTION

There are many eyeglass frame holders presently used in optical stores to display eyeglasses or sunglasses in a simulated in-use position.

Amongst these existing holders, there are eyeglass frame holders wherein, as aforesaid, the eyeglass frames are held with their bridges sitting onto supporting members attached to one or more vertical posts. In support of this contention, reference can be made to the contents of U.S. Pat. Nos. 4,558,788; 4,724,966 and 4,890,745.

Other examples of existing eyeglass frame holders conceived by the Applicant are illustrated in the appended FIGS. 9 to 14 identified as "prior art".

The above mentioned eyeglass frame holders presently available on the market have fulfilled the needs of the industry from the 1950's to the 1970's. However, due to the proliferation of new eyeglass frame designs during the last two decades, there has been an ever-increasing number of eyeglass frames with different sizes, shapes, and thicknesses which do not at all fit properly into the existing eyeglass frame holders.

The introduction into the market of other types of eyeglass frames like those displayed with clip-ons (thicker product) or rimless and very thin wire eyeglass frames, have also made some of these eyeglass frame holders obsolete. In fact, eyeglass frames have become so different, so unique and so personal that most of the traditional display units have also become non-functional. Indeed, if use is made of some of the existing eyeglass display units, the lenses and/or frame of these eyeglasses may often be damaged. In fact, the resulting damage to eyeglasses is commonplace due to the contact of the lenses and/or frame with the hard surface of the hooks, especially when the product is too thick. This problem is particularly acute with clip-ons.

Additionally, since the space allocated to holding the frame's bridge is fixed, thicker frames must be squeezed in order to fit the space, whereas thinner frames will dangle loosely, which can lead to further damage.

Moreover, groups consisting of frames of different thicknesses will have an inconsistent inclination which creates an anaesthetic asymmetry.

Another problem associated with some of the existing eyeglass frame holders is that the eyeglass frames may be subject to theft since the bridges of the eyeglasses are not securely held in place by a suitable locking means.

Thus, there is a need for an improved eyeglass frame holder for attractively supporting eyeglass frames in a plurality of positions, which holder (1) provides stable and secure support for the eyeglass frames, (2) is inexpensive and (3) easy to assemble, and (4) permits versatility in the arrangement and configuration of the display.

SUMMARY OF THE INVENTION

The object of the present invention is to provide an eyeglass frame holder that overcomes the above-mentioned drawbacks and thus qualifies as an improvement over the existing eyeglass frame holders.

More specifically, the object of the present invention is to provide an eyeglass holder comprising:

at least one vertical post, at least one supporting member for supporting an eyeglass frame comprising two glass retaining portions joined by a bridge portion, the at least one supporting member being connected to one of the at least one vertical post so as to project horizontally from it and being shaped and sized to fit into and support the bridge portion of the eyeglass frame; and a pair of retaining pins symmetrically mounted onto each of the at least one supporting member at a variable distance from the vertical post, the retaining pins extending coaxially in an horizontal direction perpendicular to the vertical post so as to come into contact and hold the glass retaining portions on both sides of the bridge portion below the same where the eyeglass frame is positioned onto said at least one supporting member, thereby allowing the eyeglass frame to be held onto the holder with its glass retaining portions extending in a substantially vertical plane.

Preferably, each of the supporting members has:

a main body with an upper surface acting as a support for the bridge portion of the eyeglass frame, a pin holder to which both of the retaining pins are attached, the pin holder being slidably mounted onto the main body so as to be adjustably positionable at a requested distance from the at least one vertical post, and means for holding the pin holder onto the main body at the requested distance once it has been positioned at said requested distance.

Preferably also, the eyeglass frame holder may be equipped with a locking means so as to keep the eyeglasses to be displayed securely from any attempt of theft. Such a locking means may comprise at least one movable plate slidably connected to the at least one vertical post and projecting perpendicularly from it, the at least one movable plate being provided with a locking post extending above each of the at least one supporting member.

Actuating means are then provided for moving the at least one movable plate up and down, whereby the locking means is in a locked position when the at least one movable plate is lowered and the locking post comes into contact with the main body of the at least one supporting member, thereby securing the eyeglasses frame mounted onto it.

The invention and its advantages will be better understood upon reading the following non-restrictive detailed description of a preferred embodiment thereof, made with reference to the accompanying drawings.

DETAILED DESCRIPTION OF THE INVENTION

In the following description, the same numerical references refer to similar elements.

In the following description also, the embodiment which is disclosed and shown in the accompanying drawing is only a preferred one. In this connection, it is worth mentioning that although the eyeglass frame holder 30 according to the preferred embodiment disclosed hereinafter comprises numerous components including, for example, locking means, actuating means, lifting means, control means, etc., which are useful and have substantial advantages, some of these components are not essential to the invention and thus should not be taken in a restrictive sense, to limit the scope of the present invention. As a matter of fact, other components could be used in the eyeglass frame holder 30 according to the present invention as described hereinafter, without departing from the scope of the invention.

Figure 1:
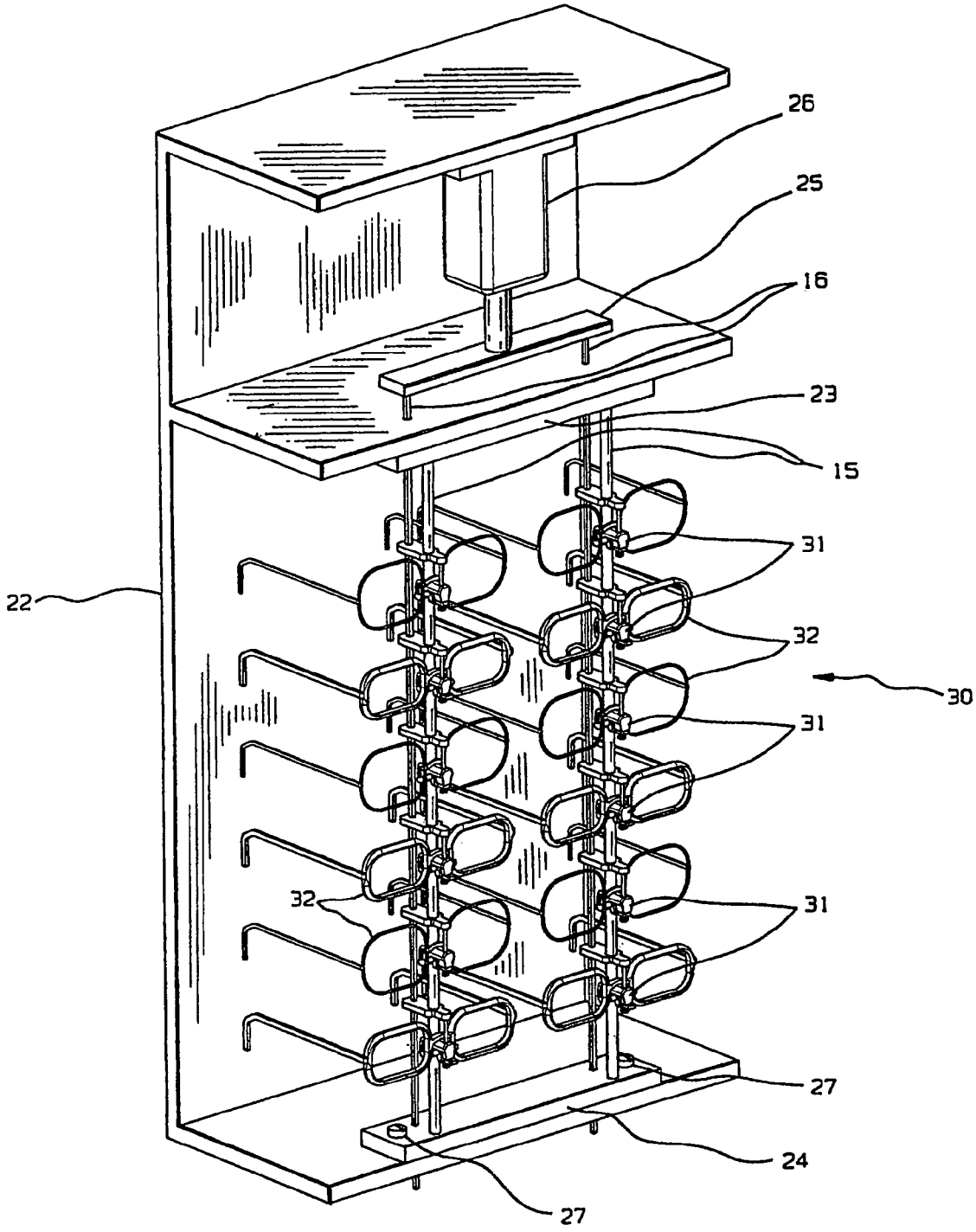
FIG. 1 is a perspective view of an eyeglass frame holder display according to a preferred embodiment of the invention.

The eyeglass frame holder 30 according to the preferred embodiment of the invention as shown in FIG. 1 of the accompanying drawing, comprises two vertical posts 15 mounted on a cabinet 22 so as to form a display.

However, the eyeglass frame holder 30 could comprise only one post or more than two posts. As a matter of fact, it could comprise an unlimited number of posts. In all cases, the posts are preferably rigidly attached to a pair of support members 23, 24 that are attached to the cabinet 22 by means of screws 27 or any other means. Preferably, the spacing between each pair of vertical posts 15 is equal to 7 inches (approximately 18 centimetres) even though any other arrangement or spacing is possible.

Figure 2:
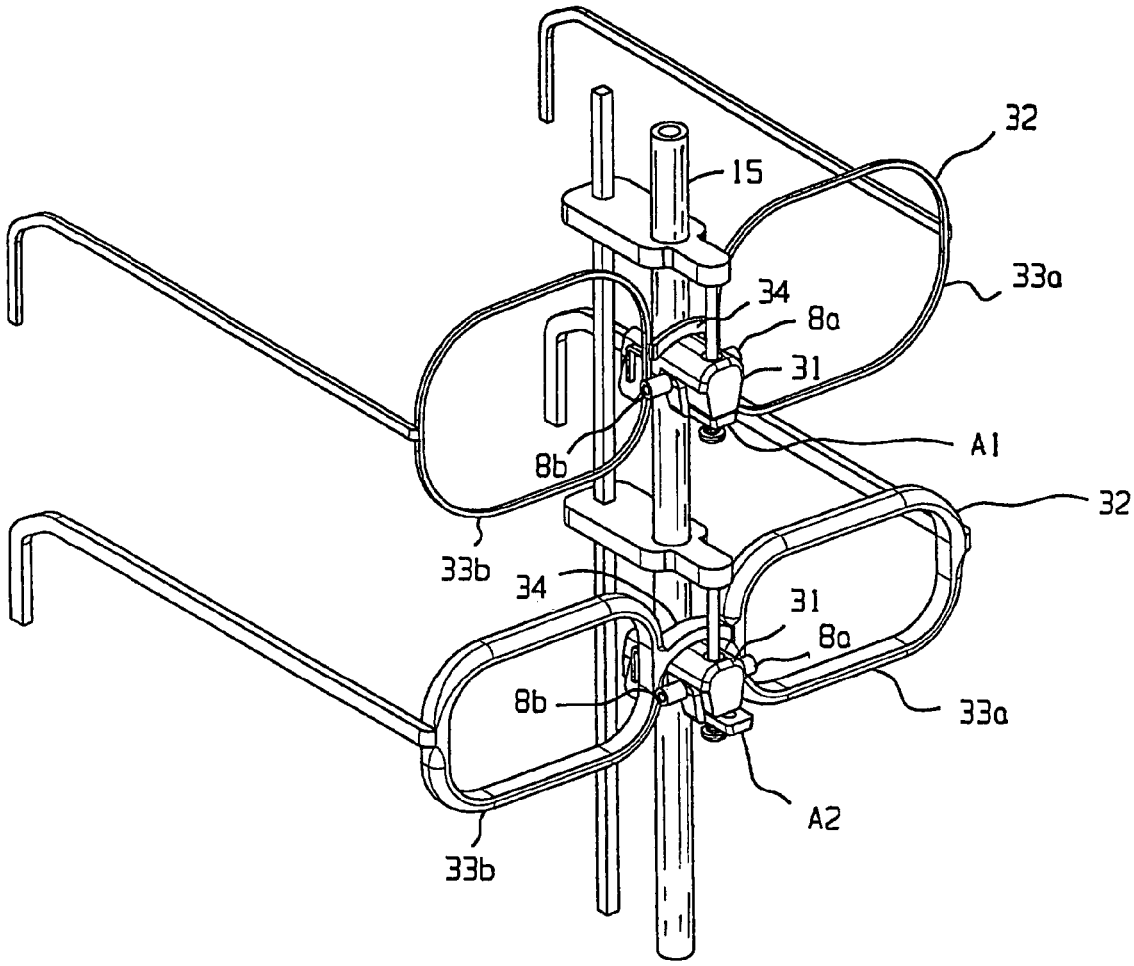
FIG. 2 is a perspective view of a portion of one of the vertical posts of the eyeglass frame holder shown in FIG. 1, with two supporting members holding two eyeglass frames of different thickness, size and shape.

The eyeglass frame holder 30 also comprises a plurality of supporting members 31 for supporting a corresponding number of eyeglass frames 32 each having two glass-retaining portions 33*a*, 33*b* joined by a bridge portion 34 (see FIG. 2). Each supporting member 31 is connected to the adjacent vertical post 15 so as to project horizontally from it. Each supporting member 31 is also shaped and sized to fit into and support the bridge portion 34 of an eyeglass frame 32.

In the illustrated embodiment, the eyeglass frame holder 30 comprises six supporting members mounted on each vertical post 15. However, this number could be different and could actually range from two to fifteen.

Preferably, the supporting members 31 mounted on each post 15 are equally spaced from one another.

Figure 7:
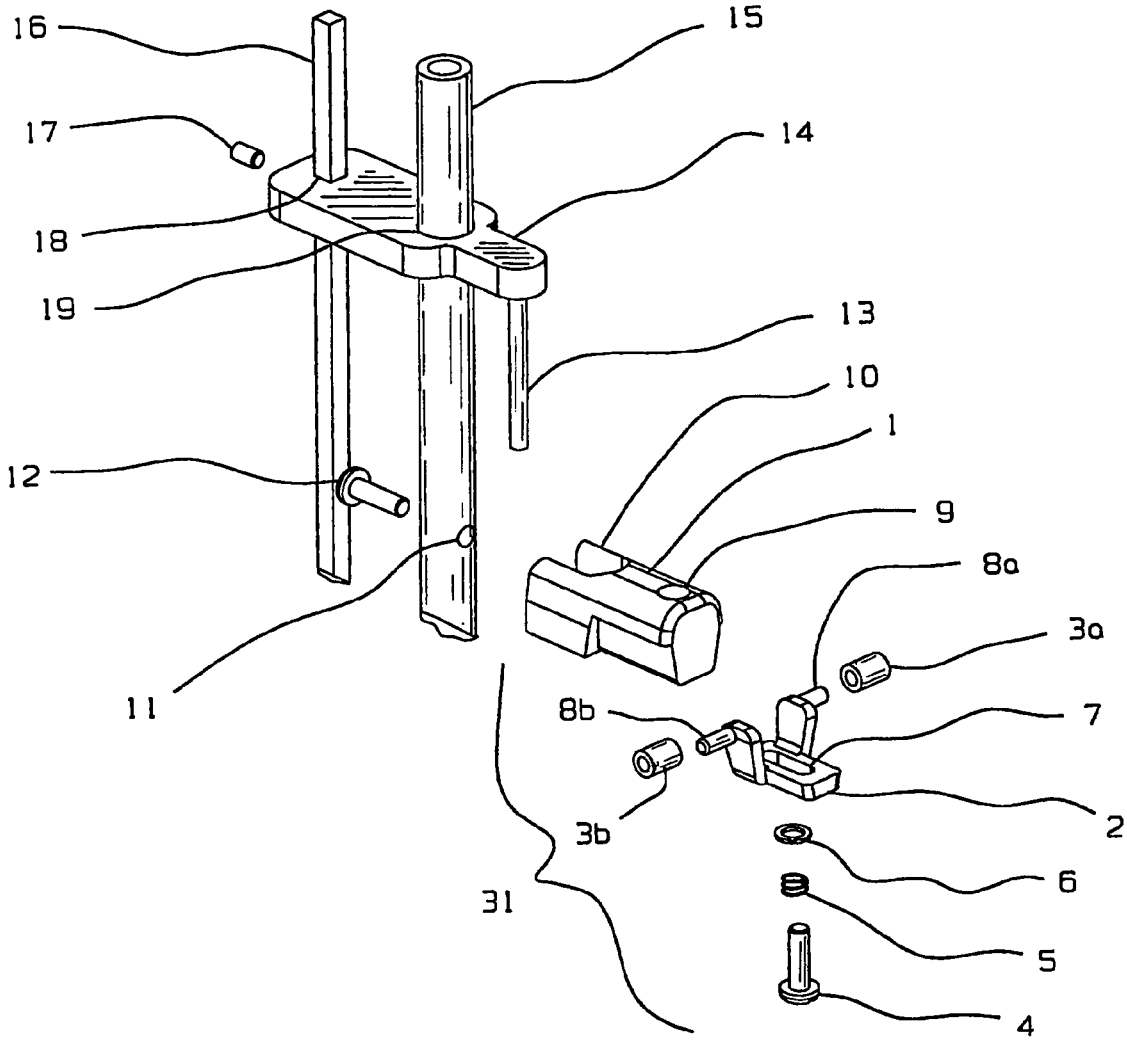
FIG. 7 is an exploded view of the elements of the eyeglass frame holder shown in FIG. 6.

Preferably also, the rear end of each supporting member 31 is provided with a "U" shaped groove 10 shaped and sized to fit onto the vertical post 15 (see FIG. 7). Such makes it possible to properly position the supporting members 31 onto the post and to hold it in horizontal position. Inasmuch as the post 15 is cylindrical, the groove 10 will be round. If, however, the cross-section of the vertical post 15 is of a different shape, the shape of the groove of the supporting member 31 will have to be of this different shape too.

Figure 6:
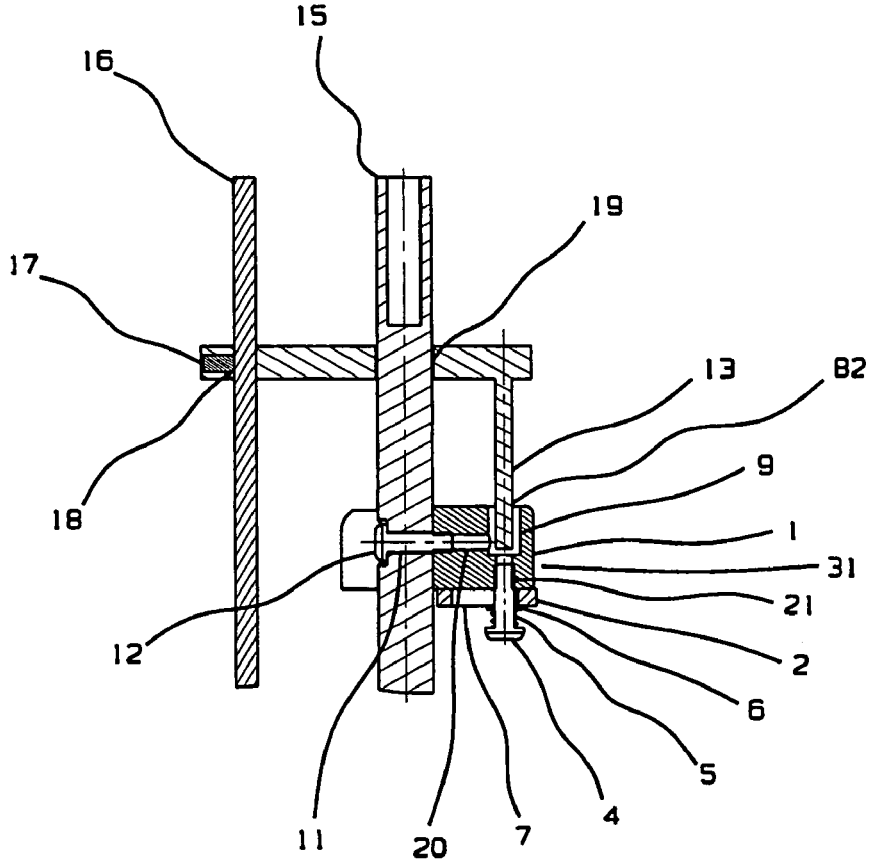

Rigid connection of the support member 31 onto the post 15 can be achieved by any suitable means, like a screw 12 that is inserted into a clearance hole 11 made in the post 15 and set into a hole 20 provided into rear end of the supporting member (see FIGS. 6 and 7). Of course, another type of connecting means known per se could alternatively be used.

Preferably also, the supporting member 31 is made of a plastic material. The plastic material is preferably transparent. The kind of plastic material used for this purpose may vary to a large extent.

In accordance with an important aspect of the invention the eyeglass frame holder 31 according to the invention further comprise a pair of retaining pins 8*a*, 8*b* symmetrically mounted onto each supporting member 31 at a variable distance from the vertical post 15 in order to allow the eyeglass frame to be held onto the holder 31 with its glass retaining portions 33*a*, 33*b* extending in a substantially vertical plane (see FIGS. 1 and 2).

As is shown, the retaining pins 8*a*, 8*b* extend coaxially in a horizontal direction perpendicular to the vertical post 15 so as to come into contact and hold the glass retaining portions 33*a*, 33*b* of the eyeglass frame 32 on both sides of the bridge portion 34 below the same where the eyeglass frame 32 is positioned onto the supporting member 31. Thus, the eyeglass frame 32 is held onto the holder 31 with its glass retaining portions 33*a*, 33*b* extending in a substantially vertical plane.

Figure 5:
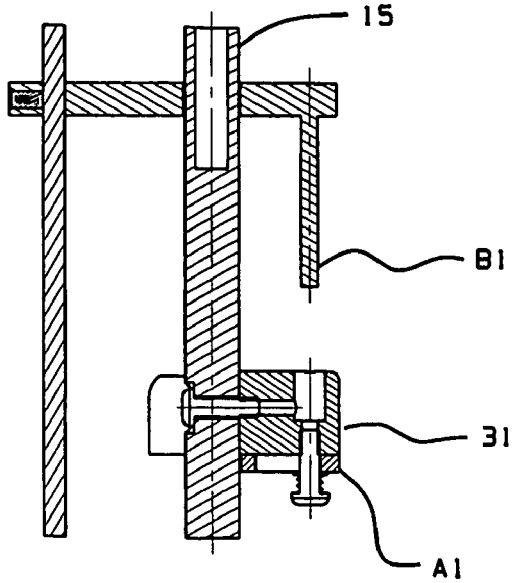
FIGS. 5 and 6 are side elevation cross-section views of part of the vertical post and one of the supporting members shown in the previous Figures, with the locking means in its locked and unlocked positions, respectively.

As is better shown in FIGS. 5 to 7, each of the supporting members 31 of the eye glass frame holder 30 according to the preferred embodiment of the invention comprises a main body 1 having an upper surface acting as a support for the bridge portion 34 of the eyeglass frame 32. The supporting member 31 also comprises a pin holder 2 (or "slipper") to which both of the retaining pins 8*a*, 8*b* are attached. The pin holder 2 is slidably mounted onto the main body 1 of the supporting member 31. Such a sliding motion allows the pin holder 2 to be adjustably positioned at any requested distance from the vertical post 15.

Of course, means are provided for holding the pin holder 2 at the requested distance onto the main body 1 once it has been positioned at such a distance. As is illustrated FIGS. 5 to 7, the pin holder 2 is provided with a longitudinal slot 7. The means for holding the pin holder 2 rigidly onto the main body 1 comprises a screw 4 set into a hole 21 made in the main body 1. A compression spring 5 and a washer 6 are mounted onto the screw 4 to apply a pressure onto the pin holder 2. The pin holder 2 can easily be pulled or pushed toward the post without using any tools to accommodate any thickness of frame. The spring pressure is sufficient to maintain the weight of any eyeglass frame without sliding under its weight. Of course, any other kind of holding means could be used, provided that it allows proper positioning of the pin holder 2 relative to the main body 1.

Preferably, each retaining pin 8*a*, 8*b* is covered with a soft tube 3*a*, 3*b*. The use of soft tubes 3*a*, 3*b*, on the retaining pin 8*a*, 8*b* advantageously prevents both slippage and damage to the adjacent glass retaining portions 33*a*, 33*b* of the eyeglass frame 32. The soft tubes 3*a*, 3*b* are preferably interchangeable and can be of adjustable length and/or diameter so as to support and properly grip eyeglass frames 32 of different thicknesses, and bridge sizes while hiding very few of the eyeglass frames.

As aforesaid, the pin holder 2 is intended to be positioned onto the main body 1 at requested distance for suitable display propose depending on the thickness of the eyeglass frame 32. Preferably, such a distance will be selected so that the glass retaining portions 33*a*, 33*b* of the eyeglass frame 32 extend in a vertical plane. However, in practice, the eyeglass frame 32 may be positioned at an angle with respect to the vertical plane if desired be to enhance the aesthetics of the eyeglass frame 32 to be displayed. In all cases, a main advantage is that it becomes possible to give the same positioning and angle to all the eyeglass frames that are being displayed onto a same post 15 whatever be their respective thicknesses. Such a flexibility of adjustment does not exist on the known holders. As a result, the angle of display may substantially vary from one eyeglass frame to the other.

Figure 3:
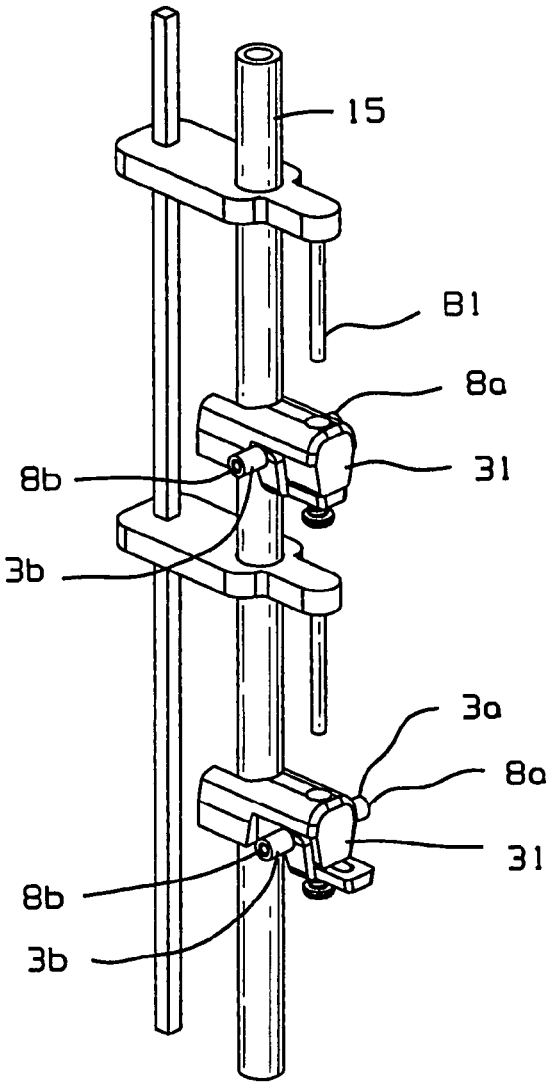
FIGS. 3 and 4 are perspective views of the portion of the eyeglass frame holder shown in FIG. 1, with its locking means in its locked and unlocked positions, respectively.
Figure 4:
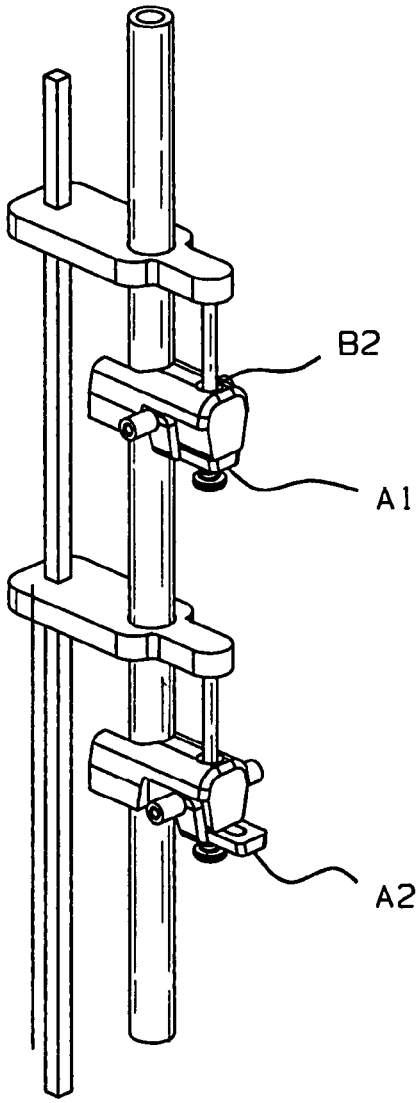

As shown in FIGS. 2 to 4, the pin holders 2 of the supporting members 31 can be set into different positions so as to display eyeglasses of different thicknesses. For example, when the pin holder 2 is set in the position called A1, a thin eyeglass frame 32 can be properly held into place. When the pin holder 2 is set in the position called A2, a thick eyeglass frame can also be properly held into place. Thus, due to its slidable mounting and its ability to be held in any given position, the pin holder 2 allows eyeglass frames 32 of different thicknesses to be displayed at a same or different angle(s).

As may also be understood from the above, not only the portion of the pin holder 2 but also the thickness, size and shape of the soft tubes 3*a*, 3*b* may actually be used to set the position and inclination of the eyeglass frame onto the supporting member 31.

As is shown in FIGS. 2, 3 and 4, the eyeglass frame holder 30 according to the preferred embodiment of the invention may also comprise locking means to keep the eyeglass frames 32 secure from any attempt of theft.

In the illustrated embodiment, the locking means comprises a plurality of plates 14 each having a clearance hole 19 to receive the vertical post 15. These plates 14 are slidably mounted onto the post 15 and project perpendicularly there from. Each plate 14 supports a locking post 13 which extends above an adjacent supporting member 31.

The locking means also comprises actuating means to move the plates 14 up and down. As better shown, FIGS. 3 and 4, the locking means is in locked position when each movable plate 14 is moved down and its locking post 13 comes into contact with the main body 1 of the adjacent supporting member 31 and is engaged into a receiving hole 9 provided in it. In such a locked position, the eyeglass frame 32 has its bridge 34 locked and can not be removed from the eyeglass frame holder 1.

The actuating means preferably comprises a vertical rod 16 parallel to each vertical post 15 for moving together all the movable plates 14 up and down along the post 15. As shown, the rod 16 is preferably of square cross-section and inserted into square holes 18 provided into the plates 14. Screws 17 are used to rigidly connected the plates 14 to the rod 16 and thus allow the latter to move all the plates 14 up and down simultaneously.

Of course, means are provided for lifting the vertical rods 16 up and down. Preferably, the lifting means comprises a bar 25 rigidly connected to the upper ends of the rods 16 and an electric motor 26 for rotating an endless screw or moving a crank to move the bar 25 and rods 26 connected to it up and down. However, the lifting means could alternatively be connected to the lower ends of the rods. Of course, any other lifting means known per se could also be used (mechanical or hydraulic).

Figure 8:
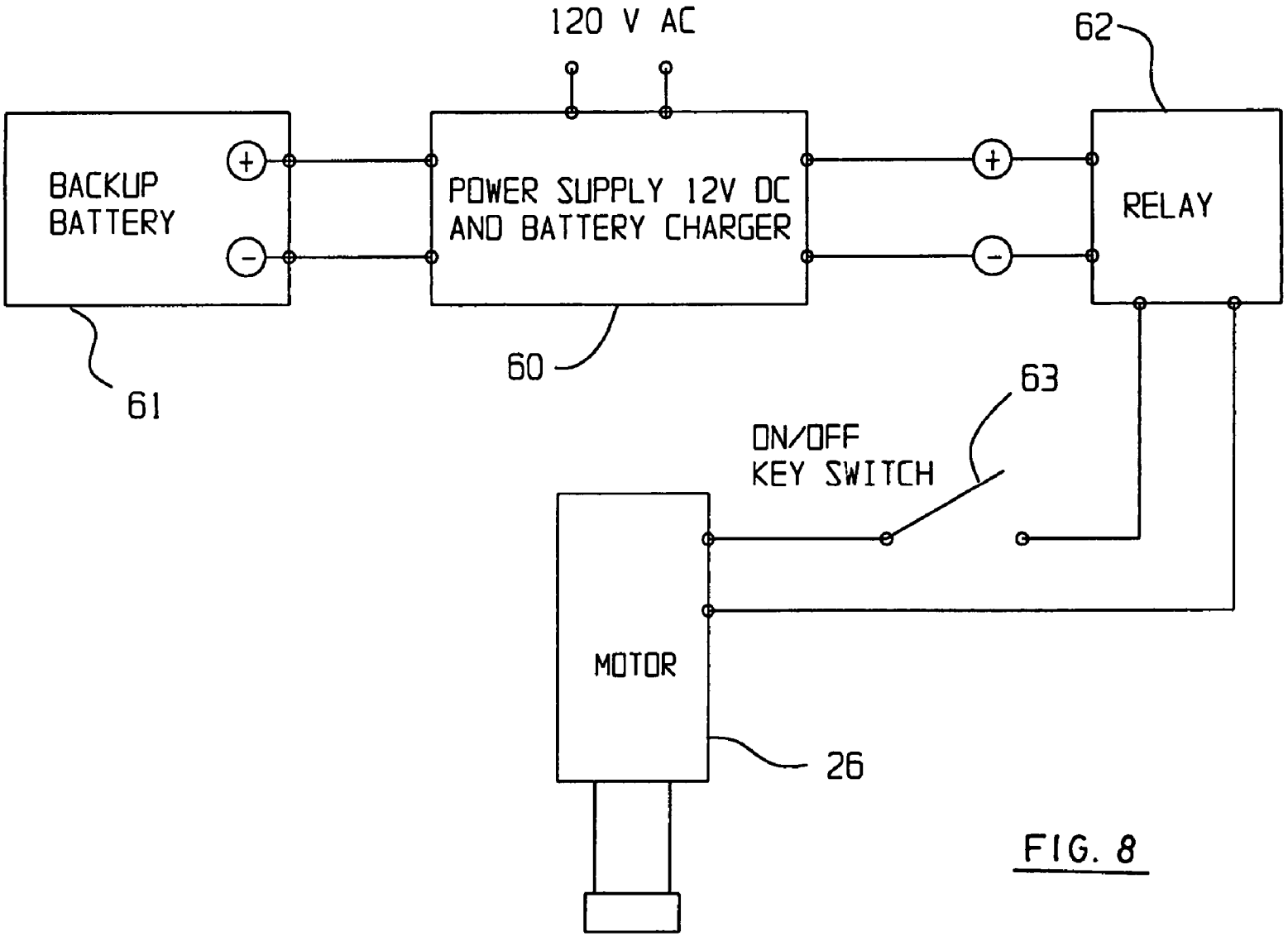
FIG. 8 is a diagram of a power supply circuit for supplying power to the actuating means of an eyeglass frame holder according to the present invention.
Figure 9:
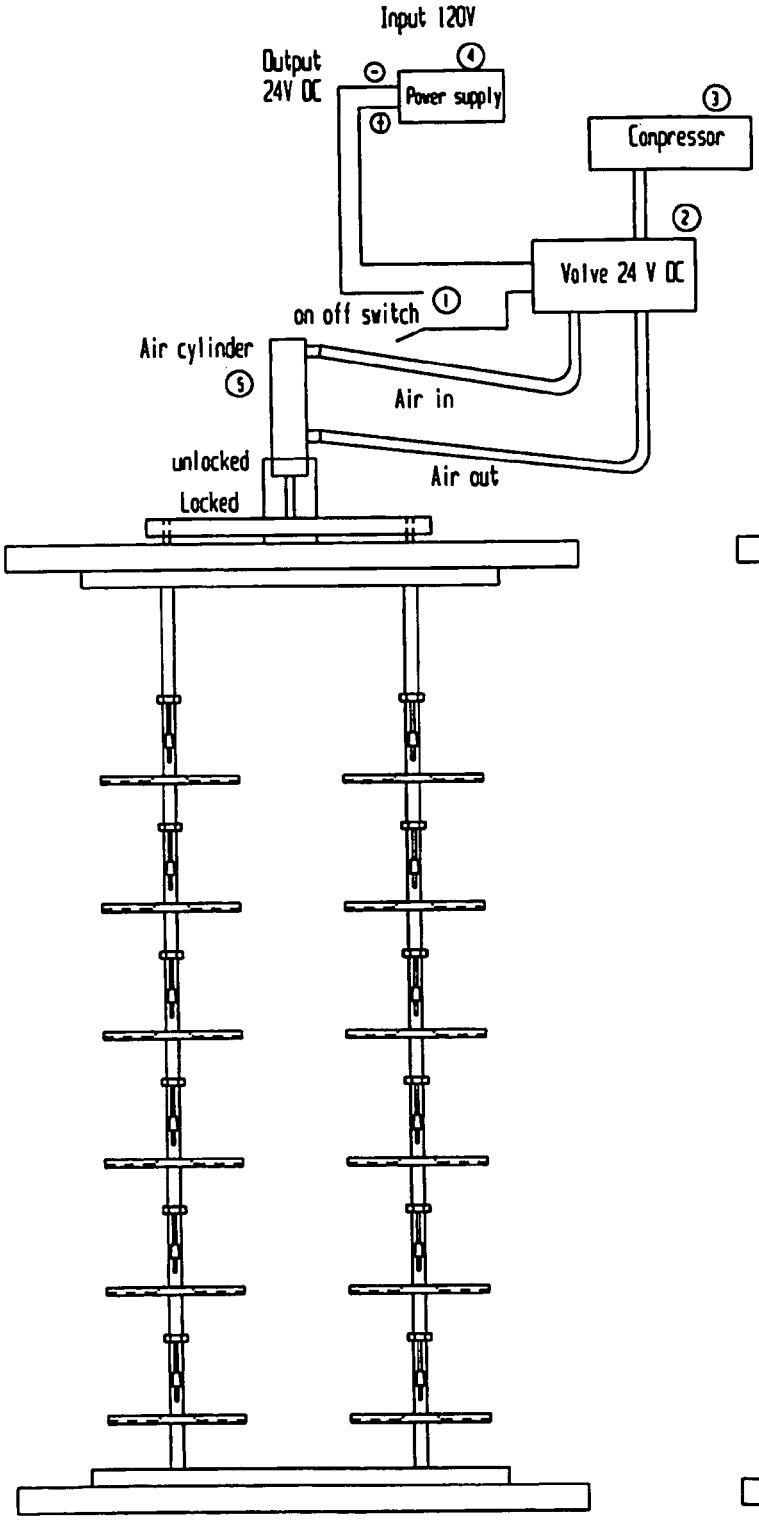
FIG. 9 (PRIOR ART)
FIGS. 9 to 14 identified as "prior art" are front and side views of two eyeglass frame holders that were conceived by the Applicant and are presently available on the market, these holders using different locking means, namely a pneumatic one in the case of the holder shown in FIGS. 9 and 10, and mechanical one in the case of the holder shown in FIGS. 11 to 14.
Figure 10:
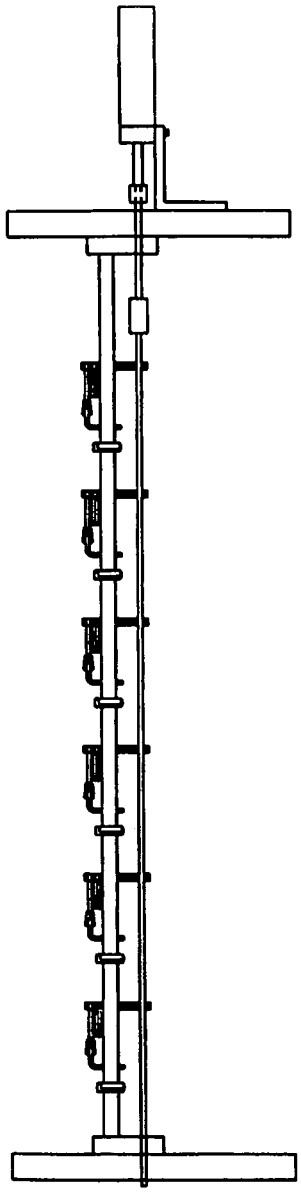
FIG. 10 (PRIOR ART)
Figure 12:
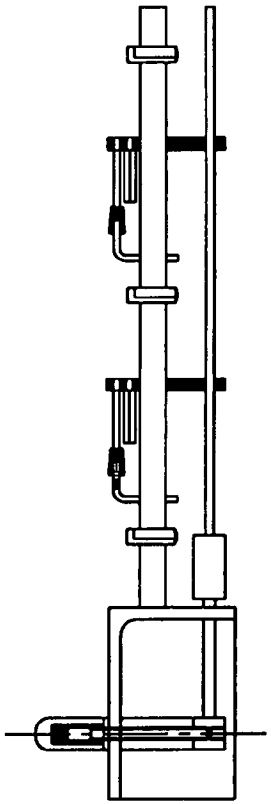
FIG. 12 (PRIOR ART)
Figure 11:
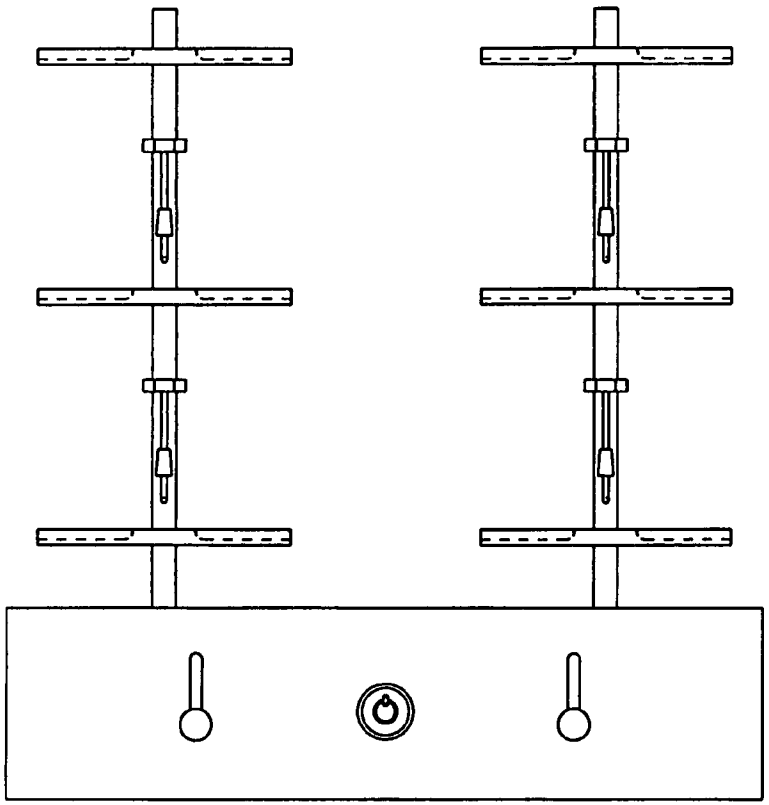
FIG. 11 (PRIOR ART)
Figure 14:
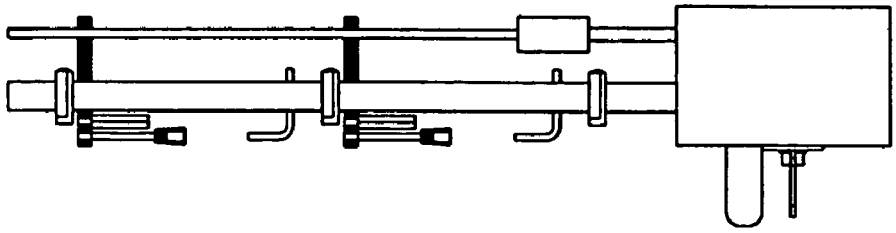
FIG. 14 (PRIOR ART)
Figure 13:
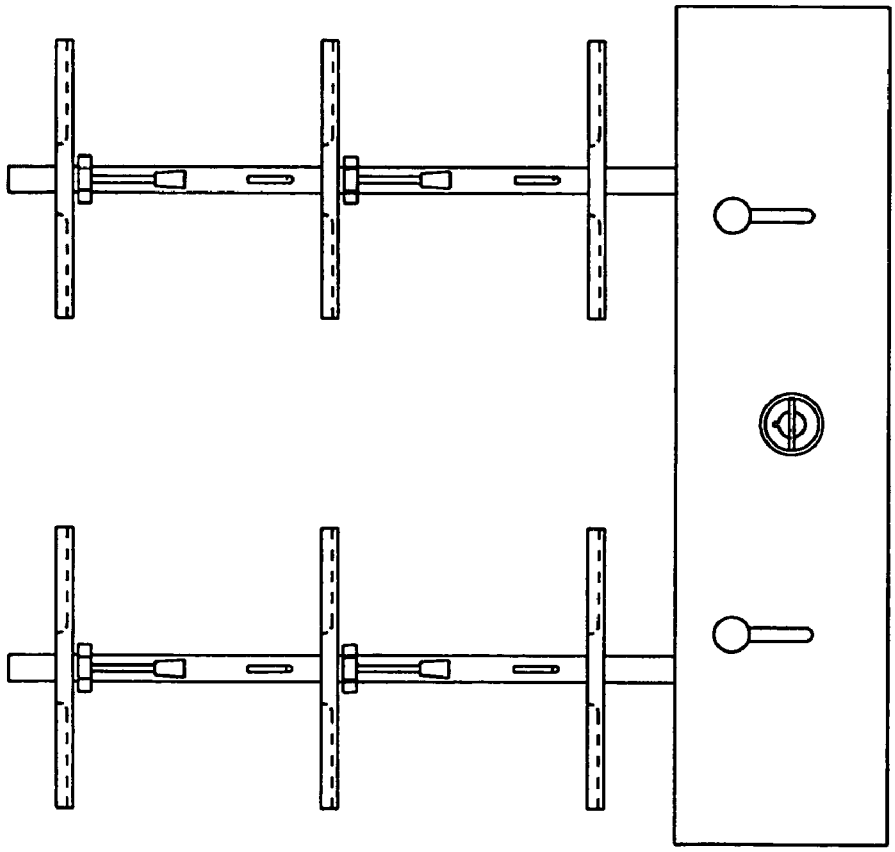
FIG. 13 (PRIOR ART)

When, as is shown, the lifting means is electrical, the eyeglass frame holder 30 is preferably provided with a back-up battery 61 so that even in the case there is a lack of power supply, the locking means may remain operational. FIG. 8 is a diagram illustrating the electric components of the lifting means used in the preferred embodiment disclosed hereinabove. As shown, a conventional 120 or 220 volt AC 50 power source is connected to a 12 volt DC power supply and battery charger 60 which is operatively connected to the back-up battery 61 to charge the same.

The 12 volt DC power supply 60 is also connected to the motor 26 via a relay 62 which is devised to invert the polarity of the poles whenever wanted and thus allows to change the direction of motion of the movable plate, thereby allowing the eyeglass frame holder 30 to be switched from its locked position to its unlocked position and vice versa. Advantageously, means (not shown) may also be provided in the circuit to automatically switch off the eyeglass frame holder 30 after a given period of inactivity and/or in the case of a power failure.

Preferably, control means 63 are provided to allow activation of the locking means by an authorized person only. These control means may consist of a key, a remote control, a card reader, a proximity card reader or a press-button.

In use, every eyeglass frame 32 to be displayed can be installed onto one of the supporting members 31 as shown in FIG. 1 or 2. More specifically, the bridge portion 34 of the eyeglass frame 32 is positioned onto the supporting member 31 in such a way that the pair of retaining pins 8*a*, 8*b* come into contact with and hold the glass retaining portions 33*a*, 33*b* on both sides of the bridge portion 34. Such permits to hold of the eyeglass frame 32 without damaging its respective glass retaining portions 33*a*, 33*b*. The pin holder 2 to which the retaining pins are attached can be adjusted at a selected distance with respect to the vertical post 15 so as to adjust at will the position the eyeglass frames 32 which can be vertical or at angle. Such also permits to accommodate eyeglass frames 32 of different thicknesses. The pin holder 2 is of course held to its support member 31 so that it does not move. The locking means can then be actuated so that the locking post 13 engages the adjacent supporting member 31 and thus secure the eyeglass frame from any attempt of theft. Of course, to remove an eyeglass frame the eyeglass frame holder 31, the locking means must be actuated in such a way that the locking post 13 is lifted up and disengaged from the supporting member to give access to the eyeglass frame 32.

As it may now be appreciated, the eyeglass frame holder 31 according to the invention is an improvement over the existing holders presently available. It actually provides a simple, non-obstructive way of displaying eyeglass frames 32 by using retaining pins 8*a*, 8*b*, which are preferably attached to a pin holder 2. The pin holder 2, which is slidably mounted onto the main body 1, permits the eyeglass frame 32 to be adjustably positioned at any requested distance from the vertical post 15. It also allows the eyeglass frame 32 to be held by their glass retaining portions 33*a*, 33*b*. It further allow frames of different thicknesses displayed on the same vertical post to be inclined at the same angle.

As already explained hereinabove, the position of the pin holder 2 and the size of the soft tubes 3*a*, 3*b* determine the inclination of the eyeglass frame. The pin holder 2 can be slid forward or backwards to support and properly adapted to various thicknesses, shapes and sizes of eyeglass frame bridges 34. The interchangeable tube 3*a*, 3*b* made out of a soft, flexible, non-slip material, also prevents scratching.

The eyeglass holder 30 according to the invention is also advantageous in that it may comprise a locking means to keep the eyeglasses secure from any attempt of theft. Once again, as opposed to the existing eyeglass frame holder, this feature provides added security to the eyeglass holder 30 according to the present invention.

The eyeglass frame holder according to the invention thus offers an efficient method of universally displaying all variety of eyeglass frame in their in-use position, without sacrificing aesthetics or ease of use. It also ensures that the eyeglass frame is not covered and can be displayed with its appropriate clip-on. Even when use is made of the optional vertical locking posts 13 for preventing theft, the position the eyeglass frames between the locking posts 13 and the vertical posts 15 does not affect their display or damage their bridges.

Although a preferred embodiment of the present invention has been described in detail herein and illustrated in the accompanying drawings, it is to be understood that the invention is not limited to this preferred embodiment and that various changes and modifications could be made therein without departing from the scope of the invention.

The invention claimed is:

1. An eyeglass frame holder, comprising:

at least one vertical post:

at least one supporting member for supporting an eyeglass frame comprising two glass retaining portions joined by a bridge portion, said at least one supporting member being connected to one of said at least one vertical post so as to project horizontally from it and being shaped and sized to fit into and support the bridge portion of the eyeglass frame; and a pair of retaining pins symmetrically mounted onto each of said at least one supporting member at a short distance from said at least one vertical post, said retaining pins extending coaxially in an horizontal direction perpendicular to the vertical post so as to come into contact and hold the glass retaining portions on both sides of the bridge portion below the same where the eyeglass frame is positioned onto said at least one supporting member, thereby allowing the eyeglass frame to be held onto the holder with its glass retaining portions extending in a substantially vertical plane;

wherein said supporting member comprises:

a main body with an upper surface acting as a support for the bridge portion of the eyeglass frame, a pin holder to which both of said retaining pins are attached, said pin holder being slidably mounted onto said main body so as to be adjustably positionable at a requested distance from said at least one vertical post; and means for holding the pin holder onto the main body at the requested distance once it has been positioned at said requested distance, and wherein said means for holding the pin holder to the main body at the requested distance comprises a screw to set the main body and a compression spring mounted on said screw.

2. The eyeglass frame holder as claimed in claim 1, wherein each of said retaining pins is covered with a soft tubing so as to prevent both slippage and damage to the adjacent glass retaining portion.

3. The eyeglass frame holder as claimed in claim 2, wherein said soft tubing is of adjustable diameter so as to fit eyeglass frames of different size and shape.

4. The eyeglass frame holder as claimed in claim 1, wherein said at least one supporting member has one end provided with a "U" shaped groove sized to fit onto said vertical post.

5. The eyeglass frame holder as claimed in claim 4, wherein said at least one supporting member is connected to said at least one vertical post by a screw.

6. The eyeglass frame holder as claimed in claim 4, wherein said at least one supporting member is made of a transparent plastic material.

7. The eyeglass frame holder as claimed in claim 1, further comprises a locking means so as to keep the eyeglasses secure from any attempt of theft, said locking means comprising:

at least one movable plate slightly connected to said at least one vertical post and projecting perpendicularly from it, said at least one movable plate being provided with a locking post extending above an adjacent one of said at least one supporting member; and actuating means to move said at least one movable plate up and down, whereby said locking means is in a locked position when said at least one movable plate is lowered and said locking post comes into contact with said main body of the at least one supporting member, thereby securing the eyeglasses frame.

8. The eyeglass frame holder as claimed in claim 7, wherein said actuating means comprises:

a vertical rod for moving said at least one movable plate up and down, said vertical rod being parallel to said at least one vertical post; and means for lifting said vertical bar up and down.

9. The eyeglass frame holder as claimed in claim 8, wherein said lifting means is mechanical.

10. The eyeglass frame holder as claimed in claim 8, wherein said lifting means is electrical.

11. The eyeglass frame holder as claimed in claim 8, wherein said lifting means is hydraulic.

12. The eyeglass frame holder as claimed in claim 8, further comprising:

control means for controlling the activation of said actuating means.

13. An eyeglass frame holder comprising at least one vertical post;

at least one supporting member for supporting an eyeglass frame comprising two glass retaining portions joined by a bridge portion, said at least one supporting member being connected to one of said at least one vertical post so as to project horizontally from it and being shaped and sized to fit into and support the bridge portion of the eyeglass frame; and a pair of retaining pins symmetrically mounted onto each of said at least one supporting member at a short distance from said at least one vertical post, said retaining pins extending coaxially in an horizontal direction perpendicular to the vertical post so as to come into contact and hold the glass retaining portions on both sides of the bridge portion below the same where the eyeglass frame is positioned onto said at least one supporting member, thereby allowing the eyeglass frame to be held onto the holder with its glass retaining portions extending in a substantially vertical plane; and a locking means so as to keep the eyeglasses secure from any attempt of theft, said locking means comprising:

at least one movable plate slightly connected to said at least one vertical post and projecting perpendicularly from it, said at least one movable plate being provided with a locking post extending above an adjacent one of said at least one supporting member; and actuating means to move said at least one movable plate up and down, whereby said locking means is in a locked position when said at least one movable place is lowered and said locking post member, thereby securing the eyeglasses frame.

14. The eyeglass frame holder as claimed in any in claim 13 wherein:

each said retaining pins is covered with a soft tubing so as to prevent both slippage and damage to the adjacent glass retaining portion; and said soft tubing is of adjustable diameter so as to fit eyeglass frames of different size and shape.

15. The eyeglass frame holder as claimed in claim 14, wherein:

said at least one supporting member has one end provided with a "U" shaped groove sized to fit onto said vertical post; and said at least one supporting member is connected to said at least one vertical post by a screw.

16. The eyeglass frame holder as claimed in claim 1, comprising from 2 to 15 of said at least one supporting member on each of said at least vertical post, all of said supporting members being spaced from one another on said at least one vertical post so as to form a display.

17. The eyeglass frame holder as claimed in claim 16, comprising from 2 to 10 of said at least one vertical post, all of said posts being mounted onto a common base in a spaced apart position so as to form a display.

18. The eyeglass frame holder as claimed in claim 13, comprising:

from 2 to 15 of said at least one supporting member on each of said at least vertical post, all of said supporting members being spaced from one another on said at least one vertical post so as to form a display; and from 2 to 10 of said at least one vertical post, all of said posts being mounted onto a common base in a spaced apart position so as to form a display.

* * * * *